US007445043B2

(12) United States Patent
Mullins et al.

(10) Patent No.: US 7,445,043 B2
(45) Date of Patent: Nov. 4, 2008

(54) SYSTEM AND METHOD FOR DETECTING PRESSURE DISTURBANCES IN A FORMATION WHILE PERFORMING AN OPERATION

(75) Inventors: Oliver C. Mullins, Ridgefield, CT (US); Fikri Kuchuk, Truro, MA (US); Andrew Carnegie, Perth (AU)

(73) Assignee: Schlumberger Technology Corporation, Sugar Land, TX (US)

( * ) Notice: Subject to any disclaimer, the term of this patent is extended or adjusted under 35 U.S.C. 154(b) by 281 days.

(21) Appl. No.: 11/355,850

(22) Filed: Feb. 16, 2006

(65) Prior Publication Data

US 2007/0187092 A1 Aug. 16, 2007

(51) Int. Cl.
*E21B 47/06* (2006.01)
*E21B 47/01* (2006.01)
*E21B 49/08* (2006.01)

(52) U.S. Cl. ..... 166/250.01; 166/250.03; 73/152.27; 73/152.28; 73/152.55

(58) Field of Classification Search ..... 166/250.01, 166/250.03, 252.1; 73/152.27, 152.28, 152.55
See application file for complete search history.

(56) References Cited

U.S. PATENT DOCUMENTS 2,708,481 A * 5/1955 Allen ..... 166/268
2,747,401 A 5/1956 Doll
3,611,799 A * 10/1971 Davis ..... 73/152.24
3,780,575 A 12/1973 Urbanosky
3,859,851 A 1/1975 Urbanosky
4,860,581 A 8/1989 Zimmerman et al.
4,936,139 A 6/1990 Zimmerman et al.
5,167,149 A 12/1992 Mullins et al.
5,201,220 A 4/1993 Mullins et al.
5,266,800 A 11/1993 Mullins
5,767,400 A * 6/1998 Nakano et al. ..... 73/152.46
5,939,717 A 8/1999 Mullins
6,062,073 A * 5/2000 Patton et al. ..... 73/152.28
6,148,664 A * 11/2000 Baird ..... 73/152.38
6,274,865 B1 8/2001 Schroer et al.
6,350,986 B1 2/2002 Mullins et al.
6,501,072 B2 12/2002 Mullins et al.
6,539,795 B1 * 4/2003 Scherpenisse et al. ..... 73/290 R
6,581,455 B1 * 6/2003 Berger et al. ..... 73/152.55

(Continued)

OTHER PUBLICATIONS

B. Raghuraman, C. Xian, A. Carnegie, B. Lecerf, L. Stewart, G. Gustavson, M.K. Abdou, A. Hosani, A. Dawoud, A. Mahdi and S. Ruefer, Downhole pH Measurement for WBM Contamination Monitoring and Transition Zone Characterization, SPE 95785, Oct. 9-12, 2005.

*Primary Examiner*—Shane Bomar
(74) *Attorney, Agent, or Firm*—Lowrie, Lando & Anastasi, LLP

(57) ABSTRACT

A method for detecting pressure disturbances in a formation accessible by a borehole while performing an operation includes positioning a tool within the borehole, positioning a first probe of the tool at a first location, positioning a second probe of the tool at a second location remote from the first location to obtain a pressure reading, performing an operation with the first probe, detecting the presence of a first phase fluid within the tool, detecting a pressure disturbance within the formation with the second probe, and identifying a second phase fluid based on the detection of the pressure disturbance. Other methods and systems for detecting pressure disturbances in the formation are further shown and described.

33 Claims, 10 Drawing Sheets

U.S. PATENT DOCUMENTS 6,729,400 B2 5/2004 Mullins et al.
6,843,119 B2 * 1/2005 Patey et al. ..... 73/152.18
6,850,317 B2 2/2005 Mullins et al.
6,938,469 B2 * 9/2005 Ganesan ..... 73/152.18
6,971,265 B1 12/2005 Sheppard
2004/0000636 A1 * 1/2004 Mullins et al. ..... 250/269.1
2004/0084180 A1 * 5/2004 Shah et al. ..... 166/250.16
2004/0221983 A1 * 11/2004 Ma et al. ..... 166/100
2004/0231408 A1 * 11/2004 Shammai ..... 73/152.27

* cited by examiner

SYSTEM AND METHOD FOR DETECTING PRESSURE DISTURBANCES IN A FORMATION WHILE PERFORMING AN OPERATION

FIELD OF THE INVENTION

The present invention generally relates to down hole tools and methods used to obtain fluid samples, and more particularly to a system and method for detecting pressure disturbances in a formation while performing an operation, such as a sampling operation.

BACKGROUND OF THE INVENTION

Down hole tools have been employed to obtain formation fluid samples. In certain prior art apparatus, fluids have been analyzed by flowing them through a fluid analyzing module of the tool. Fluid conditions, such as the permeability of the fluid through the formation, as well as the pressure, volume, temperature and acidity of the fluid, may be measured with such apparatus.

Such a down hole tool may include several modules, including but not limited to a probe module, a hydraulic module, a fluid analysis module, a pump-out module, a flow control module, one or more sample container modules, and a power module. The tool is typically suspended by a wire and lowered into a borehole. In certain embodiments, the tool may include a pair of packer modules mounted on the tool to isolate and position the probe and any other module at a certain location within the borehole. Fluid removed from the tool may be delivered to a fluid analysis module for analyzing. As used herein, "borehole" shall describe any generally tubular structure or open hole in which a device or tool is capable of being lowered into and anchored or otherwise secured within the passageway of the tubular structure or open hole. The definition of "borehole" shall include a structure adapted for oil exploration and shall also include any other structure not adapted for oil exploration, such as a pipe used to convey fluid.

Such tools may employ probe modules having two probes. By providing two probes, either through two single-probe modules or through a dual-probe module, pressure communication between adjacent formations may be monitored during an interference test. In addition, this configuration may also provide for in-situ verification of gauge quality and for redundancy in difficult conditions.

SUMMARY OF THE INVENTION

One aspect of the invention is directed to a method for detecting pressure disturbances in a formation accessible by a borehole while performing an operation. The method comprises: positioning a tool within the borehole; positioning a first probe of the tool at a first location; positioning a second probe of the tool at a second location remote from the first location to obtain a pressure reading; performing an operation with the first probe; detecting the presence of a single phase fluid within the tool; detecting a pressure disturbance within the formation with the second probe; and identifying a second phase fluid based on the detection of the pressure disturbance.

Embodiments of the method may further include identifying the second phase fluid as a gas when the first phase fluid is an oil, as an oil when the first phase fluid is water, as water when the first phase fluid is an oil, as retrograde dew and the first phase fluid is condensate, or as an asphaltene precipitation. The method may further comprise performing a response operation when a second phase fluid is identified. The response operation may include selecting a new location for positioning the tool, or, when the first phase fluid is oil, reducing a draw down pressure to minimize phase evolution, or, when the first phase fluid is water, pumping fluid until detecting oil as the second phase fluid. The act of performing an operation with the first probe may comprise performing a down hole fluid analysis.

Another aspect of the invention is directed to a system for detecting pressure disturbances in a formation accessible by a borehole. The system comprises a tool including a housing, a first probe coupled to the housing at a first position, the first probe being adapted to perform an operation, and a second probe coupled to the housing at a second position remote from the first probe, the second probe being adapted to obtain a pressure reading. A wire is coupled to the housing of the tool to support the tool in the borehole. The system further comprises a controller, coupled to the first probe and the second probe. The controller is configured to control an operation with the first probe to analyze a first phase fluid. The controller is further configured to control detection of a pressure disturbance within the formation with the second probe, and configured to analyze whether a second phase fluid may be present based on the detection of the pressure disturbance.

Embodiments of the system may include configuring the controller to identify second phase fluid as a gas when the first phase fluid is an oil, to identify second phase fluid as an oil when the first phase fluid is water, to identify second phase fluid as water when the first phase fluid is an oil, to identify the second phase fluid as retrograde dew when the first phase fluid is condensate, or to identify second phase fluid as an asphaltene precipitation. The system may be configured to perform a response operation when a second phase fluid is identified. The response operation may include selecting a new location for positioning the tool, or, when the first phase fluid is oil, reducing a draw down pressure to minimize phase evolution, or, when the first phase fluid is water, pumping fluid until detecting oil as the second phase fluid. The tool may further include a down hole fluid analysis module to perform a down hole fluid analysis operation and a dual-packer module to secure the tool at a location within the borehole.

Yet another aspect of the invention includes a method of analyzing pressure disturbances of a fluid within a formation through a borehole. The method comprises: analyzing a first phase of fluid acquired from a formation with a first probe at a first location within the borehole; detecting pressure changes within the formation with a second probe at a second location, different than the first location, within the borehole; and identifying whether the fluid within the formation has a second phase based on the pressure changes detected by the second probe.

Embodiments of the method may further include identifying the second phase fluid as a gas when the first phase fluid is an oil, as an oil when the first phase fluid is water, as water when the first phase fluid is an oil, as retrograde dew and the first phase fluid is condensate, or as an asphaltene precipitation. The method may further comprise performing a response operation when a second phase fluid is identified. The response operation may include selecting a new location for positioning the tool, or, when the first phase fluid is oil, reducing a draw down pressure to minimize phase evolution, or, when the first phase fluid is water, pumping fluid until detecting oil as the second phase fluid. The act of performing an operation with the first probe may comprise performing a down hole fluid analysis.

Another aspect of the invention is directed to a system of analyzing pressure disturbances of a fluid in a formation through a borehole. The system comprises a controller configured to receive data from a first probe located within the borehole and to analyze a first phase fluid sampled by the first probe. The controller is further configured to receive data from a second probe, spaced from the first probe within the borehole, to determine whether the fluid in the formation has a second phase based on any pressure changes detected by the second probe.

Embodiments of the system may include configuring the controller to identify second phase fluid as a gas when the first phase fluid is an oil, to identify second phase fluid as an oil when the first phase fluid is water, to identify second phase fluid as water when the first phase fluid is an oil, to identify the second phase fluid as retrograde dew when the first phase fluid is condensate, or to identify second phase fluid as an asphaltene precipitation. The system may be configured to perform a response operation when a second phase fluid is identified. The response operation may include selecting a new location for positioning the tool, or, when the first phase fluid is oil, reducing a draw down pressure to minimize phase evolution, or, when the first phase fluid is water, pumping fluid until detecting oil as the second phase fluid. The tool may further include a down hole fluid analysis module to perform a down hole fluid analysis operation and a dual-packer module to secure the tool at a location within the borehole.

BRIEF DESCRIPTION OF THE DRAWINGS

The accompanying drawings, are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION OF THE INVENTION

Figure 1A:
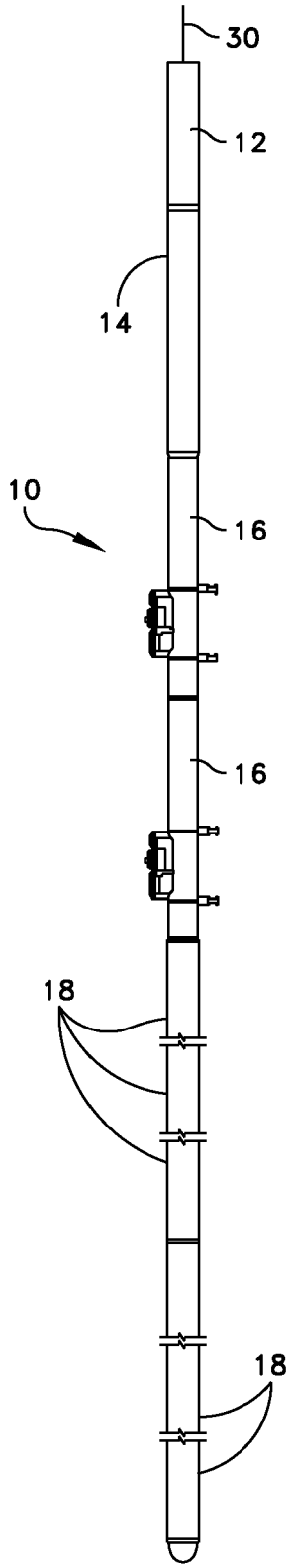
FIGS. 1A-1D are schematic representations of sampling tool configurations used to perform embodiments of the present invention.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing", "involving", and variations thereof herein, is meant to encompass the items listed thereafter and equivalents thereof as well as additional items.

As discussed above, a tool used to perform fluid analysis measurements according to various embodiments of the present invention is preferably modular in construction, e.g., comprises various modules such as a probe module, a pump-out module, a flow control module, and the like, although a unitary tool is certainly within the scope of the invention. In one embodiment, the tool is a down hole tool which may be lowered into a well bore by a wire line for the purpose of conducting formation property tests. The wire line connections to the tool, as well as power supply and communications-related electronic connections, are generally not illustrated herein for the purpose of clarity, but are understood to be part of the tool. The power and communication lines generally extend throughout the length of the tool. The power supply and communication components, as well as a controller, which is provided to control the operation of the tool, are known to those skilled in the art. The control equipment is normally installed at the uppermost end of the tool adjacent the wire line connection to the tool with the electrical and communication lines running through the tool to the various components.

In certain embodiments, the tool may embody an MDT Modular Formation Dynamics Tester offered by Schlumberger of Houston, Tex. This type of tool is adapted to provide fast and accurate pressure measurements and high-quality fluid sampling and PVT (pressure, volume and temperature) analysis. According to certain embodiments of the invention, this tool may also be adapted to measure permeability anisotropy of the fluid in the formation. One aspect of the tool is that it is modular in construction, and therefore capable of being customized as discussed herein to perform certain operations, depending on its intended use.

Referring to FIGS. 1A-1D, there are shown four exemplary tools, each having a different configuration. The description of each tool, along with their component modules, will be discussed in detail below with reference to these drawing figures.

Specifically, FIG. 1A shows a tool, generally indicated at 10, having an electronic power module 12, a hydraulic power module 14, first and second single-probe modules, each indicated at 16, and a plurality of sample container modules, each indicated at 18. This arrangement of tool 10 is a basic or typical configuration that is used primarily for obtaining pressure measurements and permeability readings of samples.

In one embodiment, the electronic power module 12 may include a power cartridge (not shown) that converts AC power from the surface of the borehole to provide DC power for all of the modules of the tool. The hydraulic power module 14 may include an electric motor (not shown) and at least one hydraulic pump (not shown) to provide hydraulic power for setting and retracting probes of the single-probe modules 16 (or probes of a dual-probe module, which will be discussed in greater detail below). The hydraulic power module 14 may further include an accumulator (not shown) that allows the probes of the single-probe module 16 to auto-retract and prevent a stuck-tool situation in the event of power failure.

Figure 2:
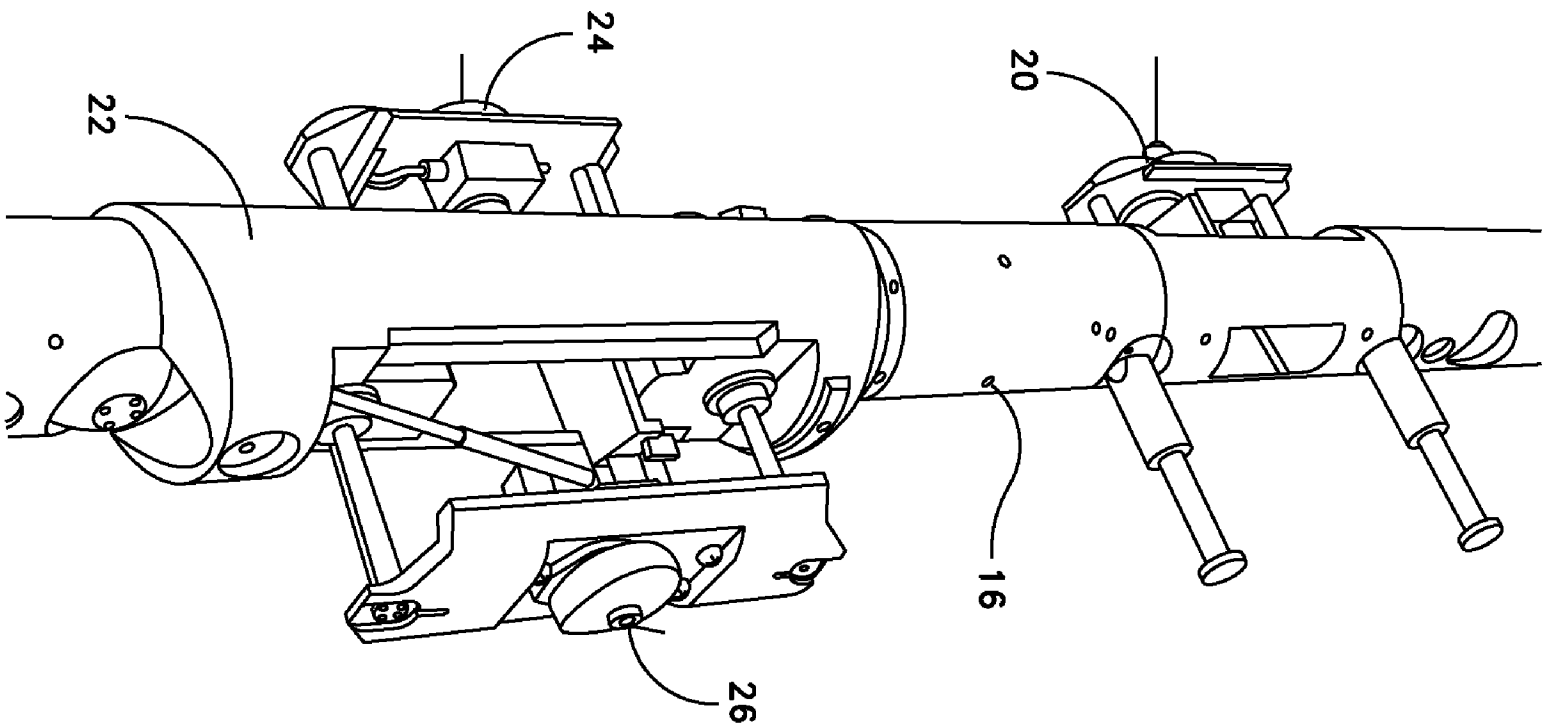
FIG. 2 is a perspective view of a single-probe module and a dual-probe module of one or more of the sampling tool configurations illustrated in FIGS. 1A-1D.

With additional reference to FIG. 2, the single-probe module 16, in one embodiment, includes a probe assembly 20 having a vertical permeability probe (not designated), as well as associated pressure gauges, fluid resistivity and temperature sensors, and a pre-test chamber, which are not specifically depicted or otherwise identified in FIG. 2. The single-probe module 16 may further include a strain gauge (not shown) and an accurate, high-resolution, quick-response gauge (not shown). The volume, rate and drawdown of this chamber can be controlled from the surface to adjust to any test situation, especially in tight formations.

In other embodiments, with continued additional reference to FIG. 2, a dual-probe module 22 may be employed. The dual-probe module 22 may contain two probe assemblies 24, 26 mounted back-to-back, 180° apart on the same block. In certain embodiments, one probe (e.g., probe assembly 24) of the dual-probe module 22 may be configured as a sink probe and the other probe (e.g., probe assembly 26) may be configured as a horizontal permeability probe as is known in the art. As shown in FIG. 2, when combined with a single-probe module 16, the single-probe and dual probe modules 16, 22 form a multi-probe system capable of determining horizontal and vertical permeability of the reservoir fluids. Specifically, during a typical test with a dual-probe module 22, formation fluids are diverted through a sink probe (e.g., probe assembly 24) to a one-liter pre-test chamber in a flow control module (not shown). The tool measures pressure as the dual-probe module, in conjunction with the pressure measured at a vertical probe (e.g., probe assembly 20) of the single-probe module 16, to measure the pressure at both probes. In one embodiment, these measurements may be used to determine near-well bore permeability anisotropy. As discussed above, by providing two probes, pressure communication between probes within the formation may be monitored during an interference test of fluid flow within the formation. Also, this probe configuration may also provide for in-situ verification of gauge quality and for measurement redundancy in difficult conditions. However, as will be discussed below, there is another advantage that can be provided according to embodiments of the invention with this configuration for conducting fluid analysis with two probes, whether with two single-probe modules 16 arranged in spaced relation or a dual-probe module 22 having spaced-apart probe assemblies.

Referring to FIG. 1A, in one embodiment, the sample container module 18 includes a single container (not shown) available in one of three sizes: 1 gallon, 2.75 gallons, and 6 gallons. An upper block (not shown) of each chamber may include a throttle valve (not shown) that may be operated in fully open, fully closed, or in throttle mode positions. With a 6-gallon chamber configuration, the chamber may be expanded in 6-gallon increments to act as dump chambers by adding additional 6-gallon chamber modules.

Figure 3:
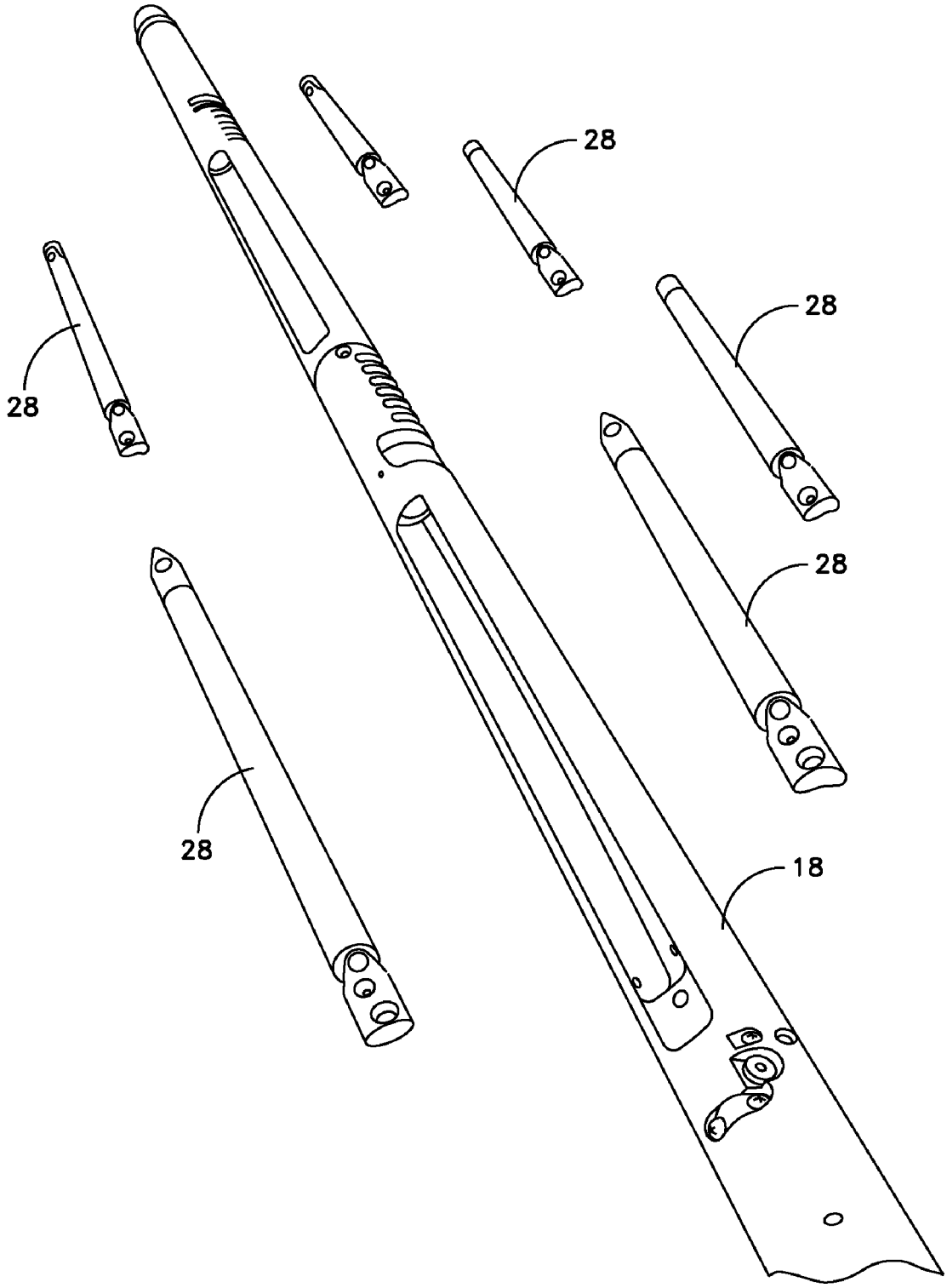
FIG. 3 is a perspective view showing a multi-sample chamber module having a plurality of discrete chambers or containers of one or more of the sampling tool configurations illustrated in FIGS. 1A-1D.

In another embodiment, as shown in FIG. 3, the sample container module 18 comprises six 450-cc chambers, each indicated at 28, that are adapted to contain high-quality samples for analysis. This arrangement provides six samples that may be collected during a single deployment of the tool 10. The six chambers 28 may embody six sample bottles that easily attach to and detach from the tool 10 for transport to a laboratory for testing. The bottles are designed to meet transportation regulations for shipping pressurized vessels, thus eliminating the need for well-site transfer.

In yet another embodiment, the sample container module 18 may comprise a single-phase, multi-sample chamber (not shown) used to collect mono-phase fluid samples by over-pressurizing the samples after they are taken at reservoir conditions. The multi-sample chamber may be pressurized with a nitrogen gas chamber adapted to apply pressure via at least one piston provided in the module. The arrangement is such that the nitrogen gas is pressurized on one side of the piston to apply pressure to the fluid sample. This arrangement also may compensate for temperature induced pressure drops as the samples are returned to the surface.

Since multiple sample container modules 18 may be combined, the total number of such modules is typically limited by the strength of a wire 30 supporting the tool 10 and the conditions of the borehole. For tools having multiple sample container modules 18, as well as highly deviated and horizontal wells, the tool 10 may be configured with a robust system to allow for heavy tools.

Figure 1B:
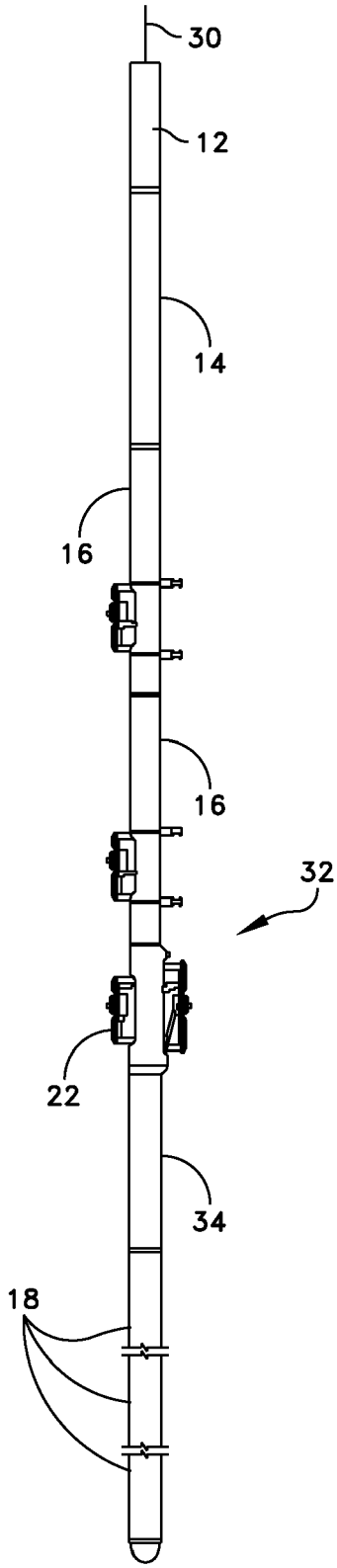

Turning to FIG. 1B, a tool, generally indicated at 32, of another embodiment is configured to include an electronic power module 12, a hydraulic power module 14, a first single-probe module 16, a second single-probe module 16, a dual-probe module 22, a flow control module 34 and a plurality of sample container modules 18. This tool configuration is particularly suited for multi-probe, vertical interference testing. For tool 32, all of the modules, except for the flow control module 34, are identical or similar to the corresponding modules describe above for the tool 10 shown in FIG. 1A. With reference to the flow control module 34, in one embodiment, this module includes a 1-liter pre-test chamber (not shown) where the flow rate may be accurately measured and controlled. The flow control module 34 may also be used during fluid sampling that requires a controlled flow rate. The flow control module 34 may be configured to create a pressure pulse in the fluid formation that is large enough for multi-probe measurements.

Figure 1C:
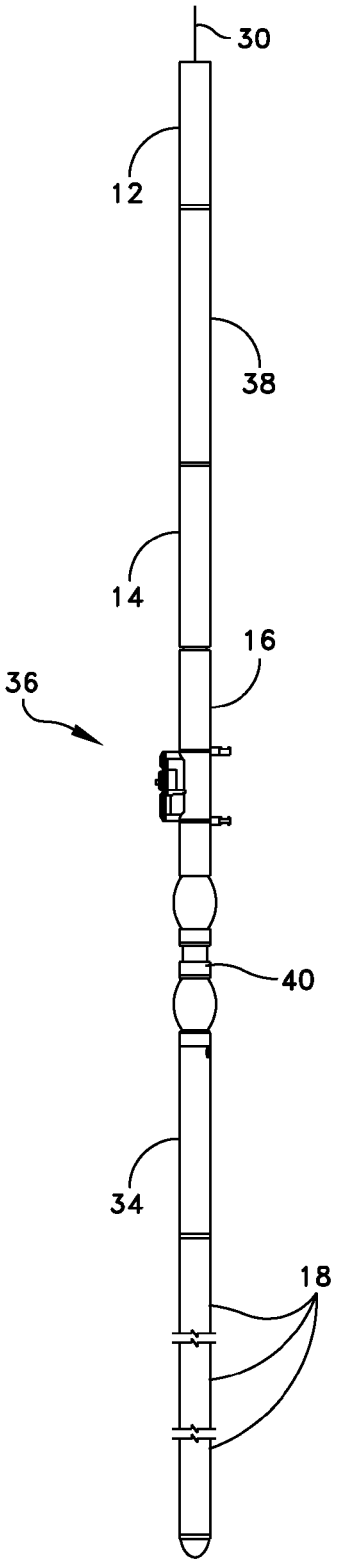

FIG. 1C illustrates a tool, generally indicated at 36, configured to include an electronic power module 12, a pump-out module 38, a hydraulic power module 14, a single probe module 16, a dual-packer module 40, a flow control module 34, and a plurality of sample container modules 18. This tool 36 configuration is particularly suited for vertical interference testing. For tool 36, all of the modules, except for the pump-out module 38 and the dual-packer module 40 are identical or similar to their corresponding modules for the tools 10, 32 described in FIGS. 1A and 1B.

The pump-out module 38 may be used to pump unwanted fluid (e.g., mud filtrate obtained from the formation) to the borehole, so that representative samples of the formation may subsequently be taken. The pump-out module 38 may also be used to pump fluid from the borehole to a flow line to inflate the dual-packer module 40, which will be described in greater detail below. Furthermore, the pump out module 38 may be configured to pump within the tool 36, for example, from a sample chamber 18 to the dual-packer module 40.

Figure 4:
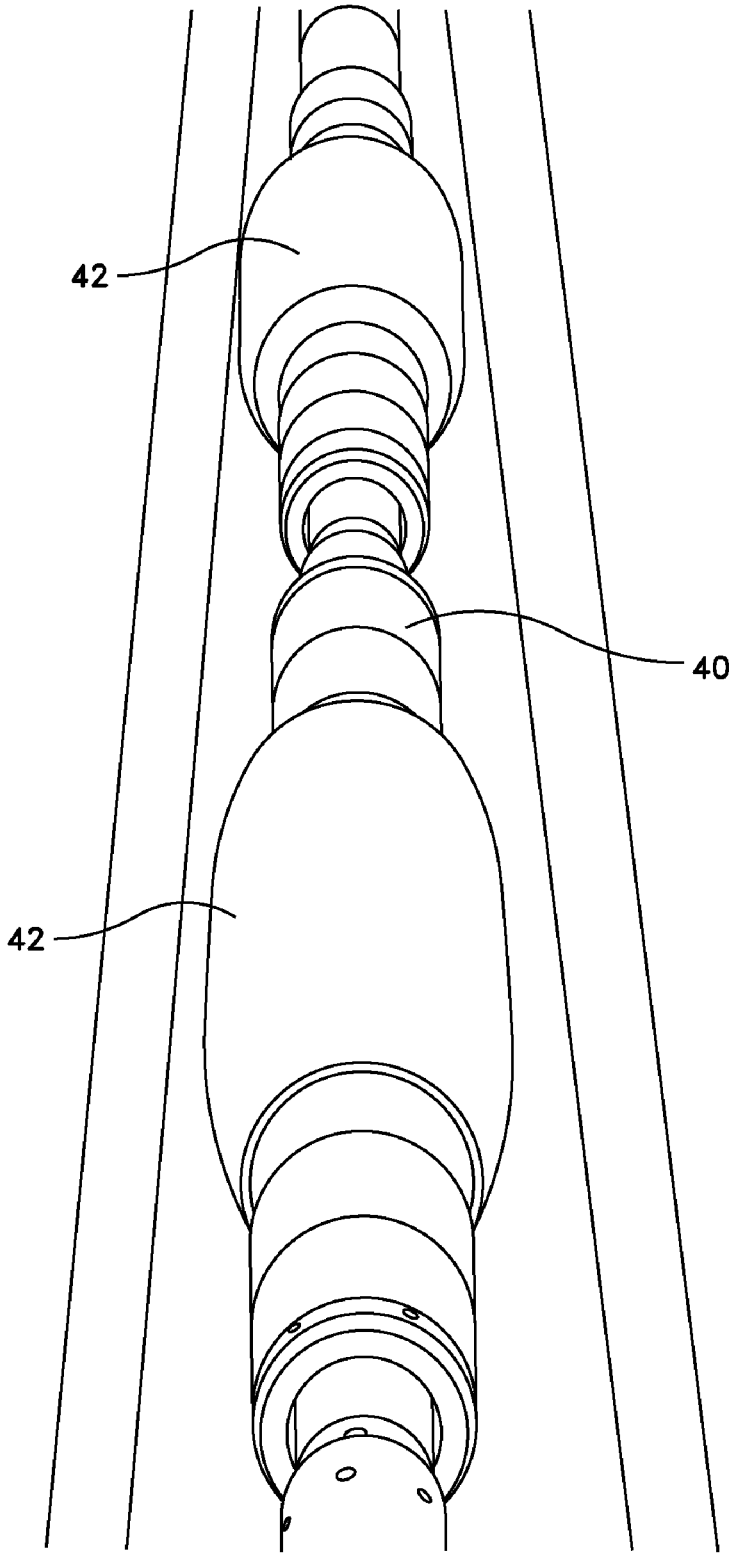
FIG. 4 is a perspective view of a dual-packer module of one or more of the sampling tool configurations illustrated in FIGS. 1A-1D.

With respect to the dual-packer module 40, which is illustrated in FIG. 4, this module may be configured to employ two or more inflatable packers, each indicated at 42, which may be inflated to engage the borehole wall to secure the tool 36 within the borehole so as to isolate a three to eleven feet section of the formation. This configuration enables the tool 36 to access the formation over a wall area that is much greater than a standard probe area, thereby enabling fluids to be withdrawn at a higher rate without dropping below a "bubble rate" limit. This configuration also provides a permeability estimate with a radius of investigation in the range of tens of feet. The dual-packer module 40 also furthers the process of obtaining pressure measurements and taking fluid samples in difficult conditions, such as tight, vuggy, fractured and/or unconsolidated formations, and in cased holes after a perforation operation. Additionally, the dual-packer module 40 may be used for in-situ stress testing and mini-fracture testing.

Figure 1D:
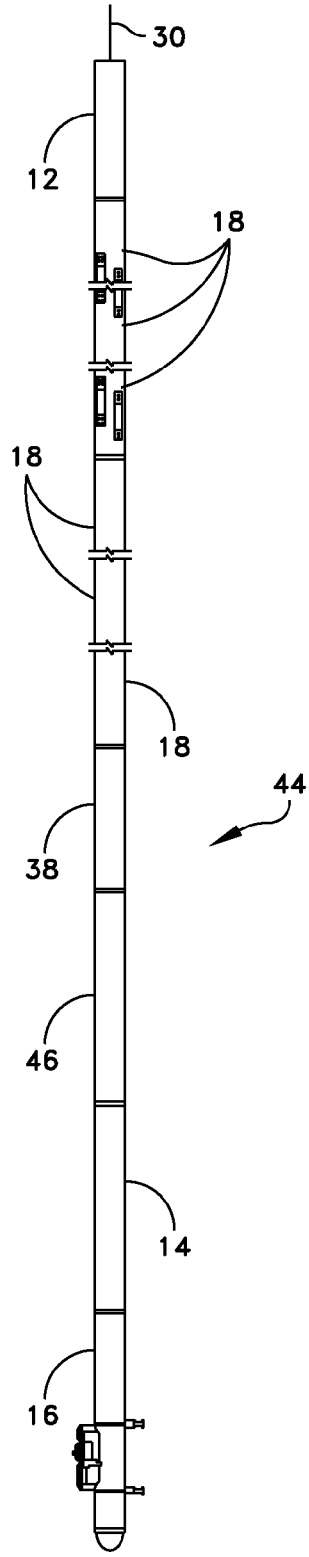

Referring to FIG. 1D, a tool, generally indicated at 44, is configured to include an electronic power module 12, a plurality of sample container modules 18, including at least one multiple container module described above, a pump-out module 38, a line fluid analyzer module 46, a hydraulic power module 14, and a single-probe module 16. This tool configuration is particularly suited for obtaining and analyzing quality samples of fluid. Specifically, reservoir fluid samples are normally evaluated in the laboratory to measure their physical and chemical properties. The accurate determination of these properties is somewhat critical, not only to characterize and produce a certain reservoir, but also to design the infrastructure used to harvest the reservoir. Errors in these measurements may have significant ramifications, even with relatively small levels of miscible contamination. To acquire a representative down hole fluid sample, the unwanted drilling fluids that invade the formation have to be removed by extracting the fluid until the level of contamination is acceptable. At this point, the fluid sample may be obtained. In one embodiment, the fluid samples may be delivered to a sample container module.

Figure 5:
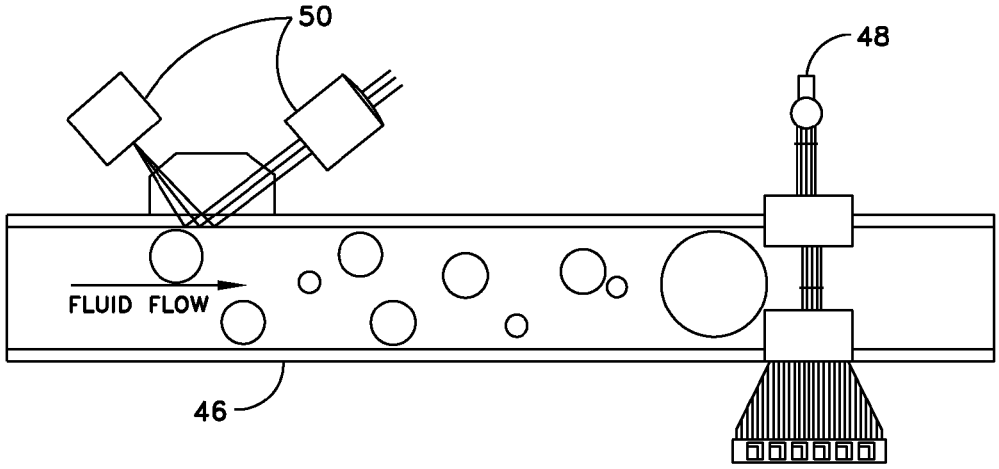
FIG. 5 is a schematic representation of a live fluid analyzer module of one or more of the sampling tool configurations illustrated in FIGS. 1A-1D.

With particular reference to FIG. 5, the live fluid analyzer module 46 is capable of analyzing fluid samples in real time. In certain embodiments, the live fluid analyzer module 46 measures optical properties of the fluid in the flow line of the tool. The live fluid analyzer module 46 may be configured to employ a first sensor 48 embodying an absorption spectrometer that utilizes visible and near infrared light to quantify the amount of reservoir and drilling fluids in the flow line. Light is transmitted through the fluid as it flows past the spectrometer. The amount of light absorbed by the fluid depends on the composition of the fluid. At certain wavelengths of near-infrared light, the molecular bonds specifically associated with a hydrocarbon fluid will vibrate. This vibration results in an absorption of light, which may be measured to identify the fluid as a hydrocarbon. Water and oil are reliably detected by their unique absorption spectra. A second sensor 50 in the live fluid analyzer module 46 may embody a gas refractometer, which can be used to differentiate between gas and liquid. Optical absorption in the visible and near infrared region may further be used for fluid discrimination and quantification.

The tools (10, 32, 36 and 44) described herein may incorporate other modules as well. For example, although not shown in FIGS. 1A-1D, a tool configuration may include a composition fluid analyzer module, which is configured to receive single-phase reservoir gas and uses near-infrared optical absorption spectrometer in real-time to determine the concentration of methane (C1), ethane-propane-butane-pentane (C2-C5), and/or heavier hydrocarbon molecules (C6+), $H_2O$, and $CO_2$. By detecting the compositional make-up of the formation fluid, the condensate/gas ratio (CGR), which is the inverse of the gas/oil ratio (GOR), may be determined. This module may also be used to measure fluorescence emission to identify fluid type and to ensure the samples are acquired above the dew point for a gas condensate.

Accurate determination of in situ sample properties is important. The composition fluid analyzer module measures the compositions of single-phase fluids. In gas reservoirs, oil vaporized in the gas precipitates as liquid and condenses at surface temperature and pressure conditions. The composition fluid analyzer module measures the composition of the condensate while it is still in the gas phase. This vaporized composition is the C6+ fraction. From the ratio of the C6+ fraction to the C1-C5 fraction, the CGR may be determined. CGR indicates the condensate yield, or the barrels of liquid that will condense from one million scf of gas at standard temperature and pressure conditions.

Figure 6:
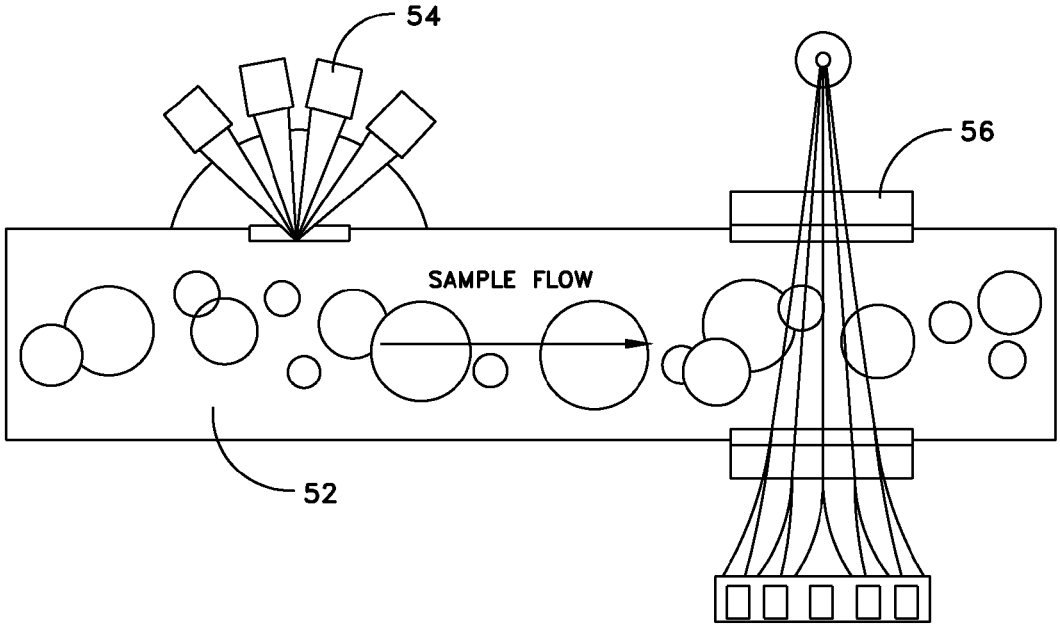
FIG. 6 is a schematic representation of a composition fluid analyzer module of one or more of the sampling tool configurations illustrated in FIGS. 1A-1D.

With reference to FIG. 6, a certain composition fluid analyzer module 52 may comprise a fluorescence detector 54 to measure fluorescence emission using a narrow-spectrum light source, and a blue-light emitting diode 56. The light is absorbed by the fluid in contact with a window (not shown) on the flow line of the tool and is then re-emitted as a wide spectrum of longer wavelengths. The fluorescence emission spectrum varies with the amount of condensate vaporized in the gas. The spectrum is reduced whenever the pressure of a condensate falls below its dew point. Therefore, the spectrum can be monitored to ensure the reservoir fluid is sampled above its dew point.

The composition fluid analyzer module may also be provided for production-optimizing information not previously available in real time. This includes fluid scanning for a compositional gradient in a thick reservoir, identification of layers with different fluids, down hole evaluation of $CO_2$ level, down hole determination of dew point, secondary recovery monitoring, and oil-based mud sampling.

Thus, it should be observed that the sampling tools described herein, due to their modularity, are adapted to be configured in any number of ways, depending on the particular requirements. The particular configurations disclosed herein are exemplary for discussing the variety of modules.

Figure 7:
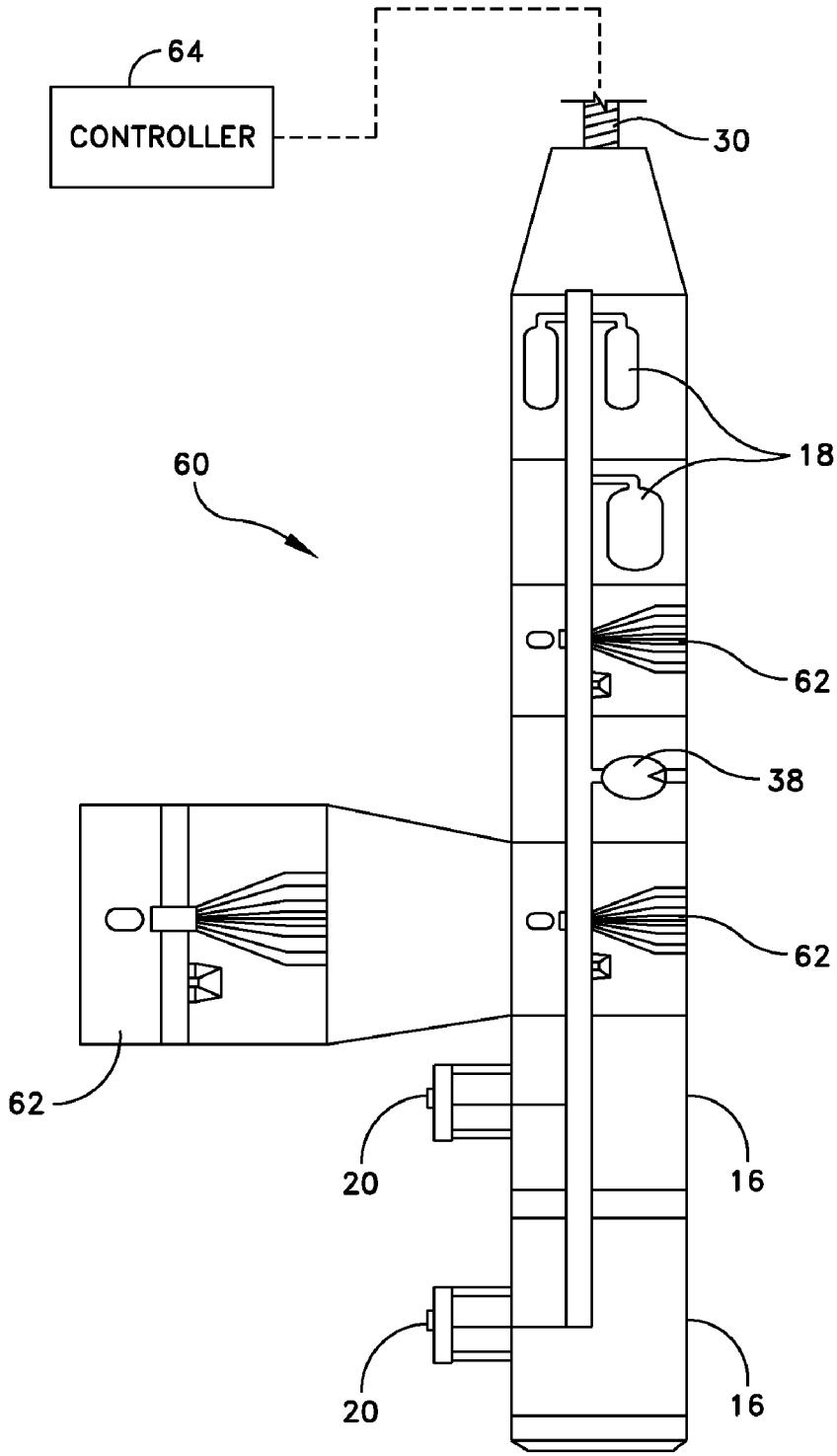
FIG. 7 is a schematic representation of a sampling tool configuration used to perform embodiments of the present invention.
Figure 8:
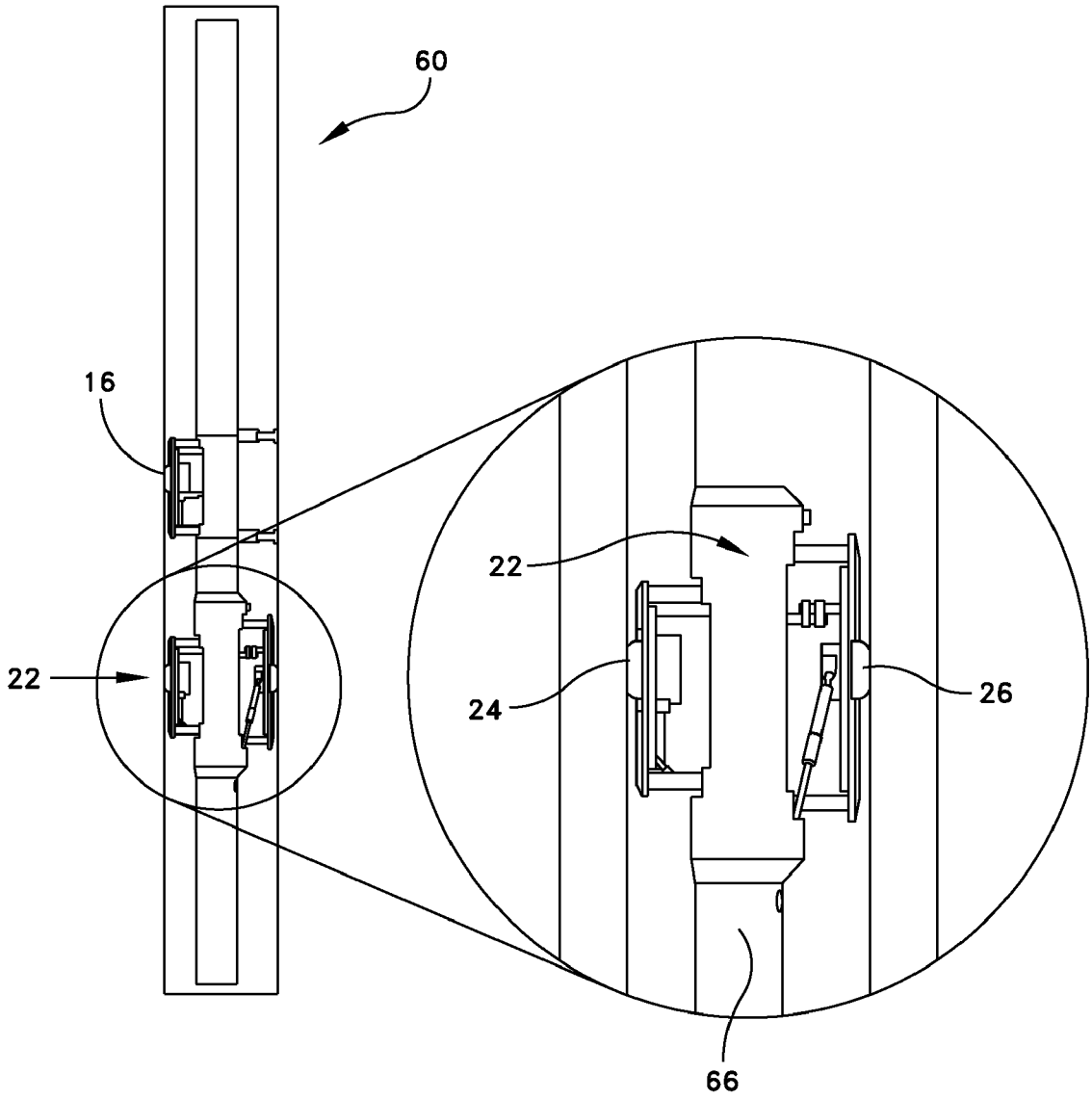
FIG. 8 is a schematic representation of a single-probe module and a dual-probe module of an alternative embodiment to the sampling tool configuration illustrated in FIG. 7, with the dual-probe module being illustrated in an enlarged view.

As discussed above, fluid sample acquisition in open hole environment is a major concern of oil and gas companies and consequently is a significant business segment for service companies. FIG. 7 shows a schematic of a standard sampling tool, generally indicated at 60, that may be used to perform the systems and methods of the present invention. As shown, the tool 60 comprises two single-probe modules 16 shown at the lowest section of the tool and two down hole fluid analysis (DFA) modules, each indicated at 62, which, in certain embodiments, may embody a live fluid analyzer module 46 and/or a composition fluid analyzer module 52. As shown in FIG. 7, the DFA modules 62 are depicted with rainbows to imply optical spectral measurements. The tool 60 further comprises a pump-out module 38, which is located between the two DFA modules 62, and two different sample container modules 18. Alternatively, as shown in FIG. 8, the tool 60 may be provided with a dual-probe module 22 and a single-probe module 16. Not depicted in FIG. 7 are the other necessary modules for operation the down hole tool, such as a telemetry module, a hydraulic power module 14, an electronic power module 12, etc., for the operation of the tool. As discussed above, the DFA tools are provided to perform a variety of functions, including sample validation. Each single-probe module 16 functions to operate as the point of sample acquisition. In addition, each single-probe module 16 is provided with an isolation valve (not shown) so that the single-probe module may monitor formation pressure without influence from the flow line pressure.

Controlling the operation of the tool 60 is a controller 64, which is schematically shown in FIG. 7. In one embodiment, the controller 64 may be a dedicated processor, or, in certain examples, a laptop computer or personal computer. In one embodiment, the controller 64 includes software that allows an expert engineer at the surface to monitor and respond to signals sent from the various modules of the tool. There is negligible delay in communication between the tool and the software. This arrangement enables the expert engineer to perform down hole operations, including DFA analysis. The controller 64 is configured to control the operation with the lowermost probe module 16 to obtain a steady state pressure reading to confirm a first phase fluid. As will be described in greater detail herein, the controller 64 is further configured to control the detection of a pressure disturbance within the formation with the uppermost probe module 16, so that a second phase fluid may be predicted based on the detection of the pressure disturbance.

In certain instances, the fluid samples may be generally hydrocarbon as well as water. As has been already discovered in the field of exploration, down hole fluid samples can be contaminated by drilling mud filtrate, especially during initial sampling. If the filtrate is not miscible, then, in general, the contamination is not overly problematic. On the other hand, if the filtrate is miscible with the formation fluids, then there exists a significant problem, especially for OBM (Oil Based Mud) filtrate in crude oil and gas sampling. With these prior art methods, the contrast in coloration between OBM filtrate and crude oil is utilized. Subsequently, these prior art methods were developed to quantify miscible hydrocarbon contamination. Additional new fluid measurements were made in part to improve the characterization of OBM filtrate contamination. Contamination concerns also exist with water sampling in the presence of water-based mud. Down hole pH methods may be further provided to quantify the level of miscible water filtrate contamination. Other concepts, such as labeling the mud system coupled with down hole detection of the label, may be employed.

When the objective is to sample a hydrocarbon which is single phase (either liquid or gas) in the formation, then a second point of concern for valid sample acquisition is that the sample should not undergo any phase transition in the process of sampling. If a phase transition occurs, then it is likely that the two different phases would not flow at the same rate. Consequently, the acquired sample would be non-representative.

More specifically, in order to move fluids into the tool from the formation, it is necessary to have a pressure drop. The tool 60 makes a hydraulic contact with the formation by forcing a probe assembly 20 of the single-probe module 16 (or probe assemblies 24 or 26 of the dual-probe module 22, as the case may be) against a borehole wall 66 with large force as shown in FIG. 8. A dual-packer module 40 around the single- or dual-probe module may be employed to seal the interior of the probe module from the borehole. This configuration establishes hydraulic communication between the tool flow line and the formation. In order to move fluids in the formation into the tool 60, a pressure drop is required and is accomplished with the pump-out module 38. If the pressure drop is sufficient to cause a phase transition in the sampled fluid, then the fluid flowing into the tool 60 will be non-representative for the fluid in the formation. Thus, the tool 60 must obtain the fluid from the formation in the phase at which the fluid rests within the formation.

When trying to sample a hydrocarbon which is at single phase in the formation, one method to guard against any deleterious phase transition is to monitor the flow for the secondary phase. Detection of a second phase alerts the operator the pressure drop is too large and that corrective measures need to be taken. The corrective measures include reducing the draw down pressure and possibly moving the tool to a new location to acquire virgin fluid. A reduction in pressure causes many crude oils to evolve a gas phase (a bubble point fluid). Thus, a gas detector may be employed in a DFA module. Retrograde condensates are routinely encountered in the oilfield. These fluids break out a liquid condensate with a pressure drop. Retrograde dew detection may also be employed to detect such condensates. Asphaltene precipitation can occur at pressures above the bubble point, and methods have been introduced to detect asphaltene precipitation onset.

As shown, the combination of these various modules may be configured for improving valid sample acquisition. However, the data obtained by the particular tool configuration is certainly not foolproof. The greatest pressure drop in fluid sampling is at the sand face so one might expect that any phase transition would occur at the sand face enabling likely acquisition of two phases. However, both of the fluid phases may not always simultaneously enter the sampling tool. Some of the possible reasons for this effect are discussed below. For example, miscible contamination may enter the near well bore region thereby altering the fluid PVT phase envelop. Thus, contamination invasion may move the point of the most likely phase transition into the formation. Furthermore, immiscible contamination may tend to displace the formation fluids away from the well bore. Consequently, the point of likely phase breakout is away from the well bore in this particular example.

If a phase transition occurs deep in the formation, a preferential phase flow (e.g., gas) is expected. First, the two phases are expected to have different mobilities. For instance, a gas phase has a much higher mobility than a liquid phase, thus gas will tend to flow preferentially. In addition, the relative permeabilities of the different phases coupled with local fluid saturations are of concern. If phase transition occurs, the "new" phase may be present below its critical saturation so no flow takes place until a sufficient local build up of this saturation occurs. Thus, it is difficult, employing past sampling methods, to detect the formation of a second phase in the formation.

During the sampling operation, if there is no phase change and no change in phase saturation in the borehole, then the time-dependent pressure profile in the formation obeys very simple relations. For instance, consider the case of OBM filtrate invasion into a crude oil of the same mobility; that is, no water and no gas. When a pressure drop is recorded at the sampling probe, the pressure drop should exhibit the same linearity with the fluid flow rate during the entire sampling job. However, if gas breakout occurs in the formation, then the formation saturations change, the relative permeabilities change, and the fluid flow at the probe exhibits a changing linearity with pressure drop at the probe. Thus, the pressure drop versus flow rate at the sampling probe should be monitored to look for evidence of phase breakout in the formation. Complicating matters is the fact that fluid is flowing through the sampling probe introduces noise into the pressure measurement. It is desirable to reduce any noise level to very low values to increase sensitivity in phase breakout within the formation.

For the tool 60 depicted in FIG. 7, there is a method for controlling the tool assembly of the present invention that is particularly directed to detect second phase breakout. Specifically, both probe assemblies 20 may be set, establishing both probes in hydraulic communication with the formation. One probe module 16 (e.g., the lowermost probe module shown in FIGS. 7 and 8) is used for sampling the fluid flow, with its isolation valve to the tool sampling line being open. The second probe module 16 (e.g., the uppermost probe module shown in FIGS. 7 and 8) is configured to monitor pressure but not to acquire a sample, with its isolation valve being closed. Thus, according to this embodiment, the pressure gauge of the second probe module records pressure of the formation without interference from pressure in the flow line. In this manner, the operator of the tool 60 via the controller 64 may monitor the conditions of formation pressure during sample acquisition and analysis. Accordingly, abrupt changes or deviations in pressure of the formation can be detected by the second probe module during sample acquisition at or adjacent to the first probe module. The abrupt changes in pressure can be monitored as an indicator of a possible deleterious phase transition, such as the presence of crude oil when water is being initially detected and pumped.

In addition, as another example of the usefulness of the tool as configured according to embodiments of the invention, in cases where water-based mud filtrate invades into an oil formation, monitoring pressure at the second probe (sometimes referred to herein as the "observation" probe) would enable one to detect oil flow prior to the oil reaching the fluid analyzers in the in the tool 60. For example, if a dual-packer module 40 is used to acquire samples, then a hydrocarbon phase which flows towards the tool might elude detection if this phase accumulates in the dead volume annulus of the dual-packer module. However, when this hydrocarbon phase flows towards the sample tool 60, the hydrocarbon phase displaces water filtrate. Again, the changing saturations cause the pressure versus flow relations to change. Thus, such an observation probe may be very useful in identifying cases where continued pumping is likely to yield desired hydrocarbons versus other cases where the zone being tested is water bearing.

The utilization of a tool, such as one of the tools configured as described above, may be employed within a system to detect the presence of a new mobile thermodynamic phase in the formation while performing a sampling operation. As discussed above, there are many methods to detect the presence of a new thermodynamic phase in a down hole sampling tool by analyzing the fluid. The objective of embodiments of the present invention is to detect the presence of such a phase in the formation, but not by analyzing the sampled fluid. Specifically, second phases of concern include: gas evolution from oil; retrograde dew from condensate; appearance of oil in water flow; asphaltene precipitation in oil; and appearance of water in oil flow.

It is appreciated that the existence of a second hydrocarbon phase in a formation means any subsequent collection of a hydrocarbon sample may be invalid due to the inability to know the exact phases and volumes that correspond to the single phase formation hydrocarbon. For example, detection of a second liquid phase (water or oil depending whichever is the first phase) means that the formation contains a movable second phase.

For example, for some crude oils, a pressure reduction may be triggered by asphaltene precipitation within the formation near the first probe (sometimes referred to herein as the "sink" probe). When sampling such oil in a well drilled with oil-based-mud, the near well bore contains filtrate. The phase behavior of the resulting hydrocarbon mixture of crude oil and OBM filtrate is very different than the phase behavior of the pure crude oil. The pressure field set up by sampling the formation at the sink probe could cause asphaltene precipitation away form the borehole face (due to high levels of filtrate at this face). The asphaltenes can create a flow blockage in the formation. Thus, near the sink probe (first probe), the pressure would drop. If the asphaltene blockage is between the first (sink) probe and the second (observation) probe, then the pressure at the observation probe would increase to reflect the increase of the formation pressure with creation of the asphaltene. Thus, the tool as configured according to the invention, can be used to monitor the pressure change at the observation probe and to predict the creator of the asphaltene precipitate blockage.

Figure 9:
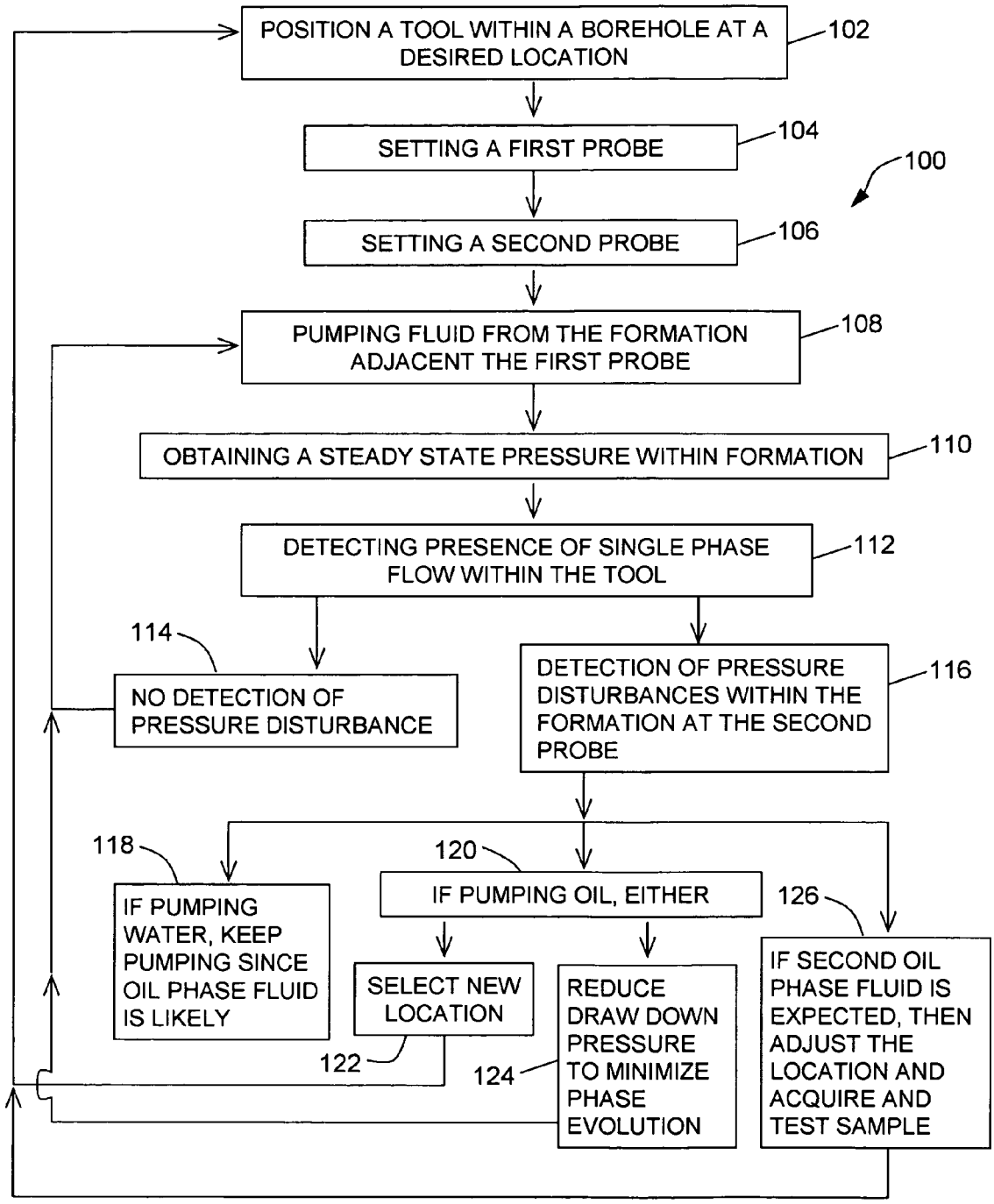
FIG. 9 is a flow diagram showing a method of an embodiment of the present invention.

Referring now to FIG. 9, in one embodiment, a method of detecting pressure disturbances in a formation while performing a sampling operation is generally indicated at 100, which includes positioning a tool (e.g., tool 60 of FIG. 7) within a borehole at a desired location adjacent a formation at step 102. At step 104, a first probe (i.e., the sink probe) is set. At step 106, a second probe (i.e., an observation probe) is set. The arrangement is such that both probes are in hydraulic communication with the formation.

At step 108, fluid is pumped from the formation at the sink probe, preferably at a constant rate. The asymptotic response of the fluid is measured at the second probe. Within this step, it is preferable to record steady state pressure at the second probe in a time period that is small with respect to overall pumping time, e.g., ten minutes might be typical. As a result, steady state pressure within the formation may be established (at step 110) and the detection of the presence of single phase flow within the tool may be obtained (at step 112). If a second thermodynamic phase is present in the tool, then it is moot whether there is a second phase in the formation. Detection of a second phase inside the tool is more robust than detecting this phase in the formation.

Using the observation probe, the detection of any significant pressure deviation from the steady state pressure may be observed. If no detection is observed (at step 114), then fluid operation of the tool continues in that fluid is pumped into the tool (step 108), steady state pressure is obtained within the formation (step 110), and single phase flow within the tool is detected (step 112). If, after a sufficient period of time, no pressure deviation is detected, the client may be informed that no second phase is detected in the formation and the corresponding sampling or down hole fluid analysis is likely to be identical to the representative sample of the formation. If such a deviation is detected by measuring a pressure disturbance within the formation at the observation probe (at step 116), then one of the following response operations may be performed:

i) for the objective of oil sampling in a water flow pumping, maintain pumping as it is likely that the oil phase is approaching the tool (step 118), ii) if pumping oil, e.g., hydrocarbon sampling in oil-based mud (step 120), plausibly a second hydrocarbon phase has evolved (gas, dew or asphaltene). Either go to a second point in the formation and pump with a smaller decrease in pressure (step 122), or (if that solution is not possible or desirable) reduce the draw down pressure drop to minimize potential phase evolution (step 124), or iii) if a second hydrocarbon phase is expected, then adjust the location and/or position of the tool in the formation to get a new representative sample. Once acquiring the sample after adjusting the location of the tool, then a down hole fluid analysis of the sample is performed by subjecting the sample to a large pressure drop to see which phase transition in the formation was likely, such as fluid to gas, retrograde dew from condensate, or asphaltene precipitation within the formation (step 126).

Specifically, the detection of a pressure disturbance by the second observation probe may indicate the presence of a second phase fluid. When such a deviation is detected, then one of several situations may exist. For example, as discussed above, if the sampling operation is detecting a first phase fluid of water, as a pressure disturbance is detected, it is desirable to maintain pumping as it is likely that the oil phase is approaching the tool (at step 118 in FIG. 9).

As another example, if the tool is sampling a hydrocarbon in an oil-based mud, the detection of a pressure disturbance may indicate that a second hydrocarbon phase has evolved, either gas, dew or asphaltene (solid). In such an instance, it may be desirable to go to a second point in the formation within the borehole where the method 100 is initiated from the beginning (as in the case of an asphaltene precipitation adjacent the sink probe), or, if it is not possible to go to a second point within the borehole, reduce the draw down pressure drop to minimize potential phase evolution (as in the case of gas phase change). When reducing the draw down pressure such that no second phase is detected, then fluid is pumped from the tool at the sink probe (at step 108), with the formation maintaining a steady state pressure (at step 110) and with the single phase fluid being detected in the tool (at step 112)

As another example, if a second hydrocarbon phase is expected, upon detecting the pressure disturbance, the location of the tool may be adjusted to a new location within the borehole. Once adjusted, the tool may acquire a sample and then perform down hole fluid analysis on the sample by subjecting the sample to a large pressure drop to see which phase transition in the formation was likely.

In performing the method shown in FIG. 9, the controller controls the operation of the tool. The controller may be programmed to perform another operation in addition to or in lieu of the sampling operation described herein. For example, the tool may be configured to measure the flow rate of the formation fluid.

Figure 10:
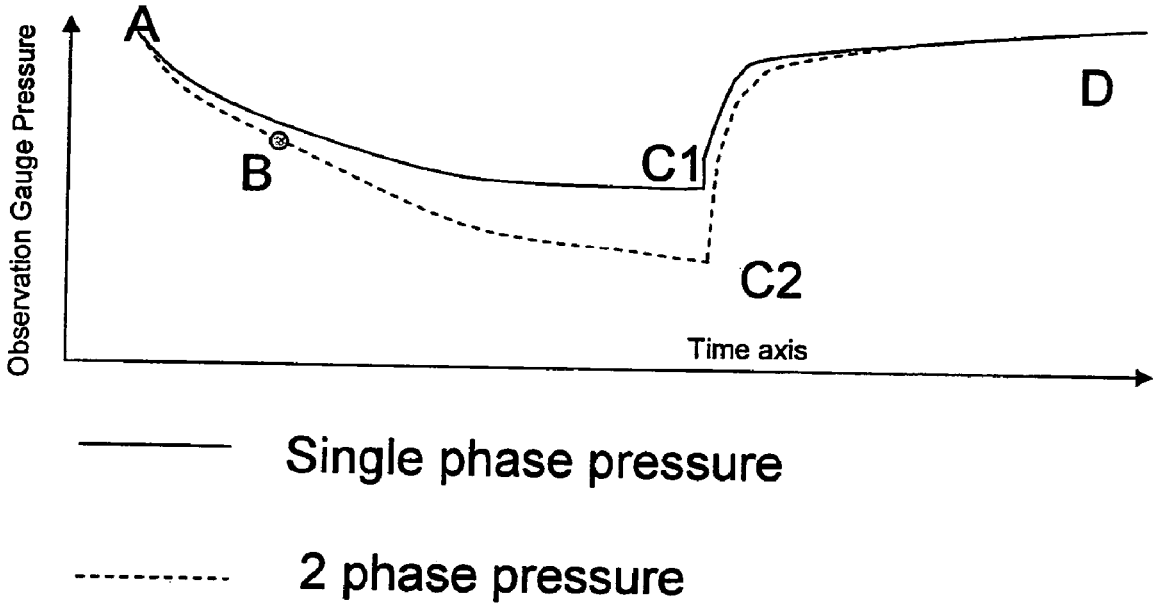
FIG. 10 is a graph representing pressure at an observation probe module of the sampling tool over time.

With reference to FIG. 10, an example of the detection of single-phase pressure and two-phase pressure is illustrated. FIG. 10 shows the pressure obtained at an observation probe over time, with the solid line representing a single-phase fluid and the dashed line representing the detection of a two-phase fluid. As shown, a sampling tool is operated to draw fluid from a formation at a constant rate, in which there is only one phase of hydrocarbon and therefore no water. This may be referred to as "phase one." If the pressure drops below the hydrocarbon "saturation pressure," a second phase will be released. This may be referred to as "phase two." The existence of phase two reduces the mobility (i.e., the ability to flow under a pressure gradient) of phase one. Therefore, because the sampling tool is drawing phase one fluid at a constant rate, when phase two fluid approaches, the pressure at the sampling tool within the formation suddenly drops.

As discussed above, the solid line represents the pressure response at the observation probe if phase two fluid never materializes. The pressure decline from points A to C1 in FIG. 10, and the build-up from points C1 to D, are relatively smooth, and may be accurately modeled by assuming that only phase one material exists. This allows a person monitoring the sampling tool to confidently conclude that only phase one fluid exists. The dashed line represents the pressure response at the observation probe when the sampling tool is operated so that pressure in the same formation drops sufficiently low (at point B in FIG. 10), so that phase two comes into existence. Point B in FIG. 10 represents a sudden drop in pressure. Thus, the decline from points B to C2 and the build-up from points C2 to D may be modeled by assuming that phase two material exists.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

We claim:

1. A method for detecting pressure disturbances in a formation accessible by a borehole while performing an operation, the method comprising:

positioning a tool within the borehole;

positioning a first probe of the tool at a first location;

positioning a second probe of the tool at a second location remote from the first location to obtain a pressure reading of the formation, the pressure reading being taken outside the tool;

performing an operation with the first probe;

detecting the presence of a first phase fluid within the tool;

detecting a pressure disturbance within the formation with the second probe outside the tool; and identifying a second phase fluid based on the detection of the pressure disturbance.

2. The method of claim 1, wherein the second phase fluid is identified as a gas when the first phase fluid is an oil.

3. The method of claim 1, wherein the second phase fluid is identified as an oil when the first phase fluid is water.

4. The method of claim 1, wherein the second phase fluid is identified as water when the first phase fluid is an oil.

5. The method of claim 1, wherein the second phase fluid is identified as retrograde dew and the first phase fluid is condensate.

6. The method of claim 1, wherein the second phase fluid is identified as an asphaltene precipitation.

7. The method of claim 1, further comprising performing a response operation when the second phase fluid is identified.

8. The method of claim 7, wherein the response operation includes selecting a new location for positioning the tool.

9. The method of claim 7, wherein the response operation includes, when the first phase fluid is oil, reducing a draw down pressure to minimize phase evolution.

10. The method of claim 7, wherein the response operation includes, when the first phase fluid is water, pumping fluid until detecting oil as the second phase fluid.

11. The method of claim 1, wherein the act of performing an operation with the first probe comprises performing a down hole fluid analysis.

12. A system for detecting pressure disturbances in a formation accessible by a borehole, the system comprising:

a tool including:

a housing;

a first probe coupled to the housing at a first position, the first probe being adapted to perform an operation; and a second probe coupled to the housing at a second position remote from the first probe, the second probe being adapted to obtain a pressure reading of the formation, the pressure reading being taken outside the tool;

a wire coupled to the housing of the tool, to support the tool in the borehole;

a controller, coupled to the first probe and the second probe, configured to control an operation with the first probe to analyze a first phase fluid, the controller further being configured to control detection of a pressure disturbance within the formation with the second probe, and configured to analyze whether a second phase fluid may be present based on the detection of the pressure disturbance.

13. The system of claim 12, wherein the controller is configured to identify the second phase fluid as a gas when the first phase fluid is an oil.

14. The system of claim 12, wherein the controller is configured to identify the second phase fluid as an oil when the first phase fluid is water.

15. The system of claim 12, wherein the controller is configured to identify the second phase fluid as water when the first phase fluid is an oil.

16. The system of claim 12, wherein the controller is configured to identify the second phase fluid as retrograde dew when the first phase fluid is condensate.

17. The system of claim 12, wherein the controller is configured to identify the second phase fluid as an asphaltene precipitation.

18. The system of claim 12, wherein the system is configured to perform a response operation when a second phase fluid is identified.

19. The system of claim 18, wherein the response operation includes selecting a new location for positioning the tool.

20. The system of claim 18, wherein the response operation includes, when the first phase fluid is oil, reducing a draw down pressure to minimize phase evolution.

21. The system of claim 18, wherein the response operation includes, when the first phase fluid is water, pumping fluid until detecting oil as the second phase fluid.

22. The system of claim 12, wherein the tool further includes a down hole fluid analysis module to perform a down hole fluid analysis operation.

23. The system of claim 12, wherein the tool further includes a dual-packer module to secure the tool at a location within the borehole.

24. A method of analyzing pressure disturbances of a fluid within a formation through a borehole, the method comprising:

analyzing a first phase of fluid acquired from the formation with a first probe at a first location within the borehole;

detecting pressure changes within the formation with a second probe, the pressure detecting being taken from outside the tool at a second location, different than the first location, within the borehole; and identifying whether the fluid within the formation has a second phase based on the pressure changes detected by the second probe.

25. The method of claim 24, wherein the second phase fluid is identified as a gas when the first phase fluid is an oil.

26. The method of claim 24, wherein the second phase fluid is identified as an oil when the first phase fluid is water.

27. The method of claim 24, wherein the second phase fluid is identified as water when the first phase fluid is an oil.

28. The method of claim 24, wherein the second phase fluid is identified as retrograde dew and the first phase fluid is condensate.

29. The method of claim 24, wherein the second phase fluid is identified as an asphaltene precipitation.

30. The method of claim 24, further comprising performing a response operation when a second phase fluid is identified.

31. The method of claim 30, wherein the response operation includes selecting a new location for positioning the tool.

32. The method of claim 30, wherein the response operation includes, when the first phase fluid is oil, reducing a draw down pressure to minimize phase evolution.

33. The method of claim 30, wherein the response operation includes, when the first phase fluid is water, pumping fluid until detecting oil as the second phase fluid.

* * * * *